US007104163B2

(12) United States Patent
Hu

(10) Patent No.: US 7,104,163 B2
(45) Date of Patent: Sep. 12, 2006

(54) TOOL KIT

(76) Inventor: Bobby Hu, 8F, No. 536-1, Ta Chin Street, Taichung (TW)

( * ) Notice: Subject to any disclaimer, the term of this patent is extended or adjusted under 35 U.S.C. 154(b) by 32 days.

(21) Appl. No.: 11/032,634

(22) Filed: Jan. 10, 2005

(65) Prior Publication Data

US 2005/0262971 A1 Dec. 1, 2005

(30) Foreign Application Priority Data

May 28, 2004 (TW) ..... 93115447 A

(51) Int. Cl.
*B25B 13/00* (2006.01)
*B25B 13/06* (2006.01)

(52) U.S. Cl. ..... 81/124.3; 81/121.1

(58) Field of Classification Search ..... 81/124.3, 81/124.4, 121.1
See application file for complete search history.

(56) References Cited

U.S. PATENT DOCUMENTS 5,079,978 A * 1/1992 Kupfer ..... 81/119
5,295,422 A 3/1994 Chow
5,330,230 A * 7/1994 Craig ..... 283/81
5,388,486 A * 2/1995 Ruzicka et al. ..... 81/124.3
5,448,930 A * 9/1995 Miner et al. ..... 81/57.39
5,857,390 A * 1/1999 Whiteford ..... 81/62
6,257,098 B1 * 7/2001 Cirone ..... 81/119
6,282,991 B1 9/2001 Hu
6,282,992 B1 9/2001 Hu
6,450,068 B1 9/2002 Hu
6,453,779 B1 9/2002 Hu
6,457,389 B1 10/2002 Hu
6,644,148 B1 11/2003 Hu
6,647,832 B1 11/2003 Hu
6,666,112 B1 12/2003 Hu
6,688,195 B1 * 2/2004 Hsien ..... 81/60
6,722,234 B1 4/2004 Hu
6,732,614 B1 5/2004 Hu
6,962,100 B1 * 11/2005 Hsien ..... 81/186
7,000,505 B1 * 2/2006 Hsien ..... 81/121.1
2004/0244543 A1 * 12/2004 Barnett et al. ..... 81/62
2005/0061116 A1 * 3/2005 Hsien ..... 81/121.1
2005/0092138 A1 * 5/2005 Hsien ..... 81/186

* cited by examiner

*Primary Examiner*—David B. Thomas
(74) *Attorney, Agent, or Firm*—Alan D. Kamrath; Nikolai & Mersereau, P.A.

(57) ABSTRACT

A tool kit includes a number of wrenches of various sizes and a corresponding number of go-through type sockets. Each wrench includes a handle with a box end with a nominal size. Each socket includes an engaging portion for engaging with the box end of a corresponding one of the wrenches. The engaging portion includes a nominal size the same as that of the corresponding one of the wrenches. Each socket further includes a driving portion having a driving hole with a nominal size the same as that of the corresponding one of the wrenches.

22 Claims, 14 Drawing Sheets

| nominal size (mm) | 6 | 7 | 8 | 9 | 10 | 11 | 12 | 13 | 14 | 15 | | 29 | 30 | 31 | 32 | 33 | 34 |
|---|---|---|---|---|---|---|---|---|---|---|---|---|---|---|---|---|---|
| A | 6 | 7 | 8 | 9 | 10 | 11 | 12 | 13 | 14 | 15 | | 29 | 30 | 31 | 32 | 33 | 34 |
| B | 6 | 7 | 8 | 9 | 10 | 11 | 12 | 13 | 14 | 15 | | 29 | 30 | 31 | 32 | 33 | 34 |
| C | 6 | 7 | 8 | 9 | 10 | 11 | 12 | 13 | 14 | 15 | | 29 | 30 | 31 | 32 | 33 | 34 |

Fig. 4

| nominal size (inch) | 5/32 | 3/16 | 7/32 | 1/4 | 9/32 | 5/16 | | 11/16 | 3/4 | 13/16 | 7/8 | 15/16 | 1 |
|---|---|---|---|---|---|---|---|---|---|---|---|---|---|
| A | 5/32 | 3/16 | 7/32 | 1/4 | 9/32 | 5/16 | | 11/16 | 3/4 | 13/16 | 7/8 | 15/16 | 1 |
| B | 5/32 | 3/16 | 7/32 | 1/4 | 9/32 | 5/16 | | 11/16 | 3/4 | 13/16 | 7/8 | 15/16 | 1 |
| C | 5/32 | 3/16 | 7/32 | 1/4 | 9/32 | 5/16 | | 11/16 | 3/4 | 13/16 | 7/8 | 15/16 | 1 |

Fig. 7

TOOL KIT

BACKGROUND OF THE INVENTION

1. Field of the Invention

The present invention relates to a tool kit. In particular, the present invention relates to a tool kit comprising a set of wrenches and a set of go-through type sockets.

2. Description of the Related Art

A typical socket wrench kit comprises a socket wrench and a plurality of sockets of various sizes. Each socket has a standard cavity in an end thereof for engaging with a drive column of the socket wrench. The cost for the user is relatively low, as a single socket wrench can be used to drive dozens of sockets. However, the torque imparted from the socket wrench is too large for some of the sockets. Further, the drive column of the socket wrench is an obstacle to operation in a limited space, such as the engine room of an automobile. Combination wrenches having a box end and an open end are the common option for users in this case. However, after driving the fastener through a certain angle, the user has to disengage the combination wrench from the fastener and then reengage with the fastener for next driving, and the procedure is repeated until the fastener is tightened/loosened to the desired extent. To solve this problem, ratchet type combination wrenches have been designed, allowing the user to freely turn the combination wrench in a reverse direction without driving the fastener. These small-head high-torque reversible combination wrenches are popular to automobile mechanics.

In one design of the small-head high-torque reversible combination wrenches, as illustrated in FIG. 3 of U.S. Pat. No. 5,295,422, the wrench includes a box end in which a wheel is rotatably mounted. The wheel includes a hexagonal inner periphery (or engaging surface) with six faces for engaging with an engaging surface of a bolt or a socket. However, the driving strength or torque is insufficient, as only six points are connected and engaged between the engaging surfaces of the wheel and the bolt (or socket).

To solve this problem, U.S. Pat. No. 5,295,422 discloses a wrench having a greater driving strength. The wrench comprises a handle portion and a head portion. A sleeve is rotatably engaged in the head portion and can be controlled to rotate in either direction. A go-through type socket includes a barrel engaged in an inner engaging surface of the sleeve. The user of the wrench of this type must purchase a set of go-through type sockets of various sizes, resulting in an additional cost. In use, as illustrated in FIG. 1 of the drawings, the wrench 10 can be used with a set of go-through type sockets 20*a* and 20*b* of various sizes. For a socket (e.g., socket 20*a*) including a driving hole 21*a* with a nominal size B greater than the nominal size A of the wrench 10, the torque imparted to the socket 20*a* is insufficient. On the other hand, for a socket (e.g., socket 20*b*) including a driving hole 21*b* with a nominal size C smaller than the nominal size A of the wrench 10, the torque imparted to the socket 20*b* is too large. Further, in a case that the socket 20*b* is selected for driving a fastener in a narrow, deep receptacle, the large head portion of the wrench 10 could not enter the narrow, deep receptacle. Driving of the fastener by the wrench 10 is thus impossible.

SUMMARY OF THE INVENTION

In accordance with a first aspect of the present invention, a tool kit comprises a number of wrenches of various sizes and a corresponding number of go-through type sockets.

Each wrench comprises a handle with a box end with a nominal size. Each socket comprises an engaging portion for engaging with the box end of a corresponding one of the wrenches. The engaging portion includes a nominal size the same as that of the corresponding one of the wrenches. Each socket further comprises a driving portion including a driving hole with a nominal size the same as that of the corresponding one of the wrenches.

Each wrench may further include a wheel that is rotatably mounted in the box end of the handle and that defines an inner periphery with the nominal size. Each wrench further includes means for changing a driving rotation direction and a free rotation direction of the wrench.

In an embodiment of the invention, the box end of each wrench includes a polygonal inner periphery. The engaging portion and the driving hole of each socket are polygonal.

In another embodiment of the invention, the box end of each wrench includes a star-polygonal inner periphery. The engaging portion of each socket includes a star-polygonal outer periphery. The driving hole of each socket is star-polygonal.

In a further embodiment of the invention, the box end of each wrench includes an inner periphery having a plurality of protruded portions and a plurality of recessed portions that are alternately disposed. The engaging portion of each socket includes an outer periphery having a plurality of protruded portions and a plurality of recessed portions that are alternately disposed. The driving hole of each socket includes an inner periphery having a plurality of protruded portions and a plurality of recessed portions that are alternately disposed.

In still another embodiment of the invention, the box end of each wrench includes an inner periphery having a plurality of relatively wider recessed portions and a plurality of relatively narrower protruded portions that are alternately disposed. The engaging portion of each socket includes an outer periphery having a plurality of relatively wider protruded portions and a plurality of relatively narrower recessed portions that are alternately disposed. The driving hole of each socket includes an inner periphery having a plurality of relatively wider recessed portions and a plurality of relatively narrower protruded portions that are alternately disposed.

In an embodiment of the invention, the inner periphery of the wheel of each wrench includes an annular groove. Each wrench further includes a retainer for retaining the engaging portion of a corresponding one of the sockets.

The engaging portion of each socket may include a recessed portion for engaging with the box end of the corresponding one of the wrenches.

Preferably, the number of the wrenches is greater than two.

Preferably, the engaging portion of each socket includes a through-hole in communication with the driving hole of the socket.

In accordance with a second aspect of the invention, a go-through type socket kit comprises at least three go-through type sockets of various sizes. Each said go-through type socket comprises an engaging portion for engaging with a box end of a wrench. Each go-through type socket further comprises a driving portion with a driving hole for driving a fastener. The engaging portion of each go-through type socket comprises an outer periphery with a nominal size that same as that of the driving hole.

Other objectives, advantages, and novel features of the invention will become more apparent from the following detailed description when taken in conjunction with the accompanying drawings.

BRIEF DESCRIPTION OF THE DRAWINGS

FIG. 4 is a table showing various metric nominal sizes for the wrenches and go-through type sockets of the tool kit in accordance with the present invention.

FIG. 7 is a table showing various inch nominal sizes for the wrenches and go-through type sockets of the tool kit in accordance with the present invention.

DETAILED DESCRIPTION OF THE PREFERRED EMBODIMENTS

Figure 8:
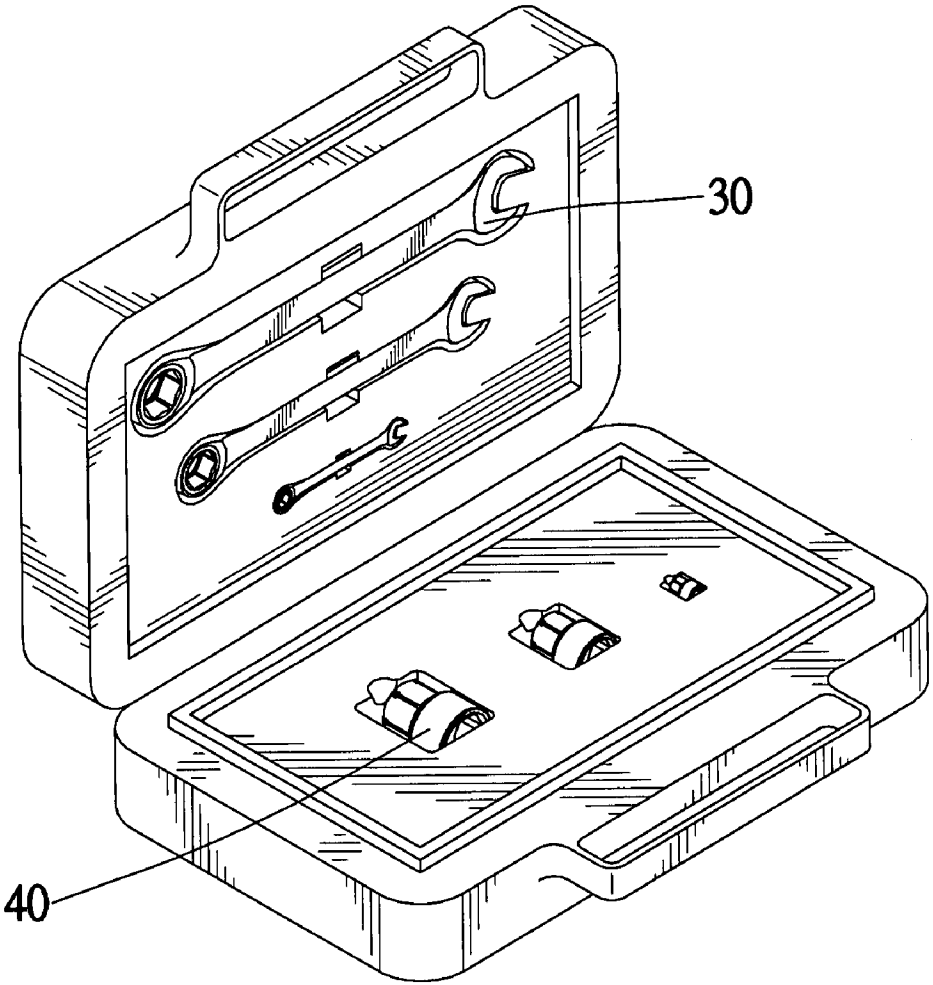
FIGS. 8 and 9 are perspective views of tool cases with tool kits in accordance with the present invention.

A tool kit in accordance with the present invention comprises a set of wrenches of various sizes and a set of go-through type sockets of various sizes corresponding to those of the wrenches. The number of the go-through type sockets is the same as that of the wrenches, and each go-through type socket is used with an associated one of the wrenches. FIG. 8 illustrates a tool case with a tool kit in accordance with the present invention. In the illustrated embodiment, the tool kit comprises three wrenches 30 of various sizes and three go-through type sockets 40 of various sizes. In the embodiment illustrated in FIGS. 2 and 3, each wrench 30 includes a handle 34 and a wheel 31 rotatably mounted in a box end 35 of the handle 34. Switching means 32 may be provided to change a driving rotation direction for driving a fastener and a free rotation direction not driving the fastener. Examples of the switching means 32 include but not limited to those disclosed in U.S. Pat. Nos. 6,732,614; 6,722,234; 6,666,112; 6,647,832; 6,644,148; 6,457,389; 6,453,779; 6,450,068; 6,282,992; 6,282,991.

The wheel 31 comprises an inner periphery 311 including a plurality of faces. In the illustrated embodiment, the inner periphery 311 includes six faces that can be used to directly drive a fastener such as a bolt, nut, etc. The nominal size of the wheel 31 is designated by A (see FIGS. 2 and 2A). Each socket 40 includes an engaging portion 41 for engaging with the inner periphery 311 of the wheel 31 and a driving portion 44 for driving a fastener such as a bolt, nut, etc. The engaging portion 41 is preferably polygonal (hexagonal in this embodiment) and includes an outer periphery having a plurality of faces and a through-hole 45. The nominal size of the engaging portion 41 of each socket 40 is designated by B (see FIG. 2). The driving portion 44 includes a driving hole 42 that is delimited by a plurality of faces and that is in communication with the through-hole 45 (see FIG. 6) of the engaging portion 41, wherein the nominal size of the driving hole 42 of the socket 40 is designated by C (see FIG. 2).

Figure 1:
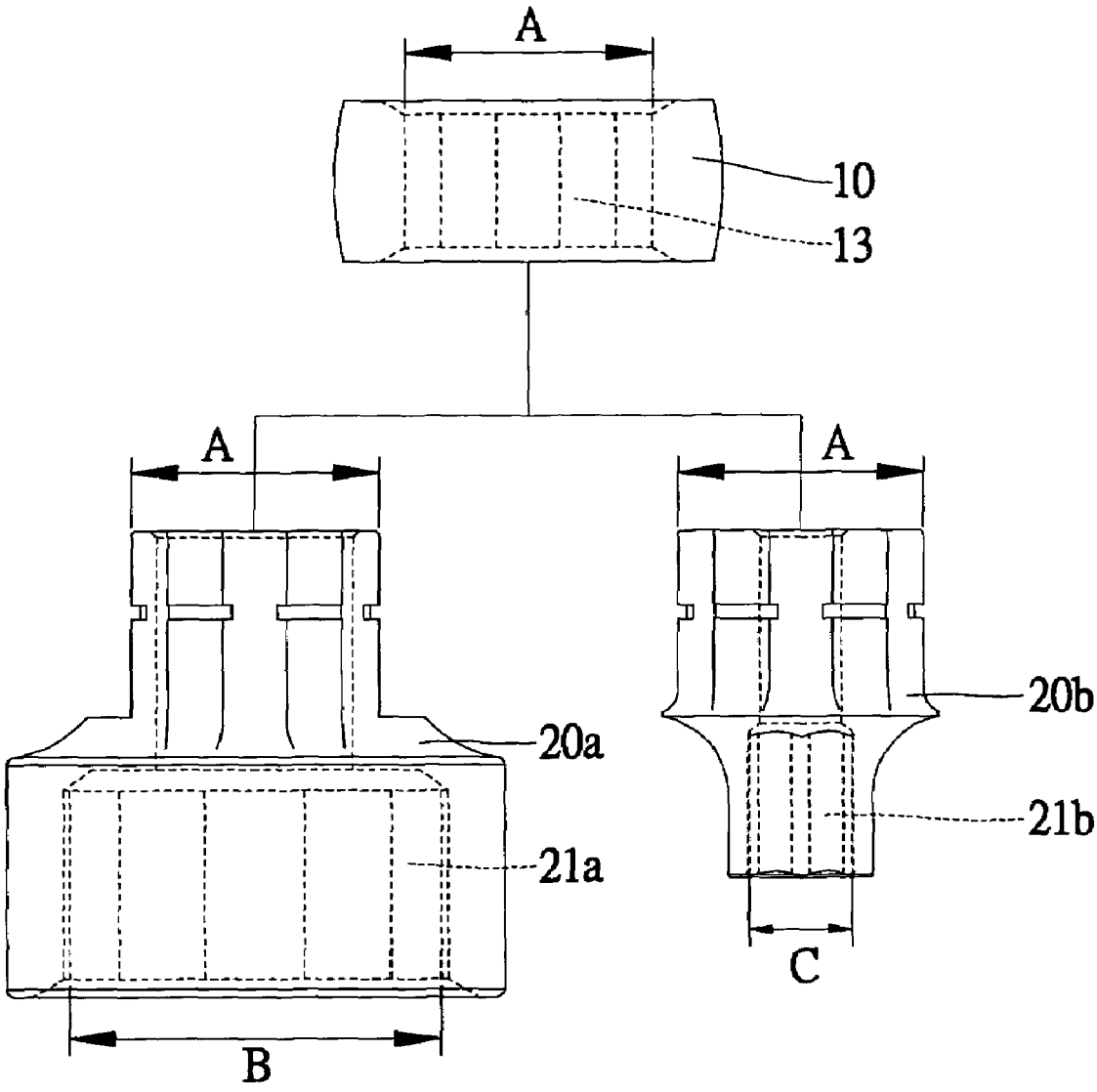
Fig. 1 PRIOR ART
FIG. 1 is a schematic exploded side view illustrating a conventional tool kit.
Figure 2:
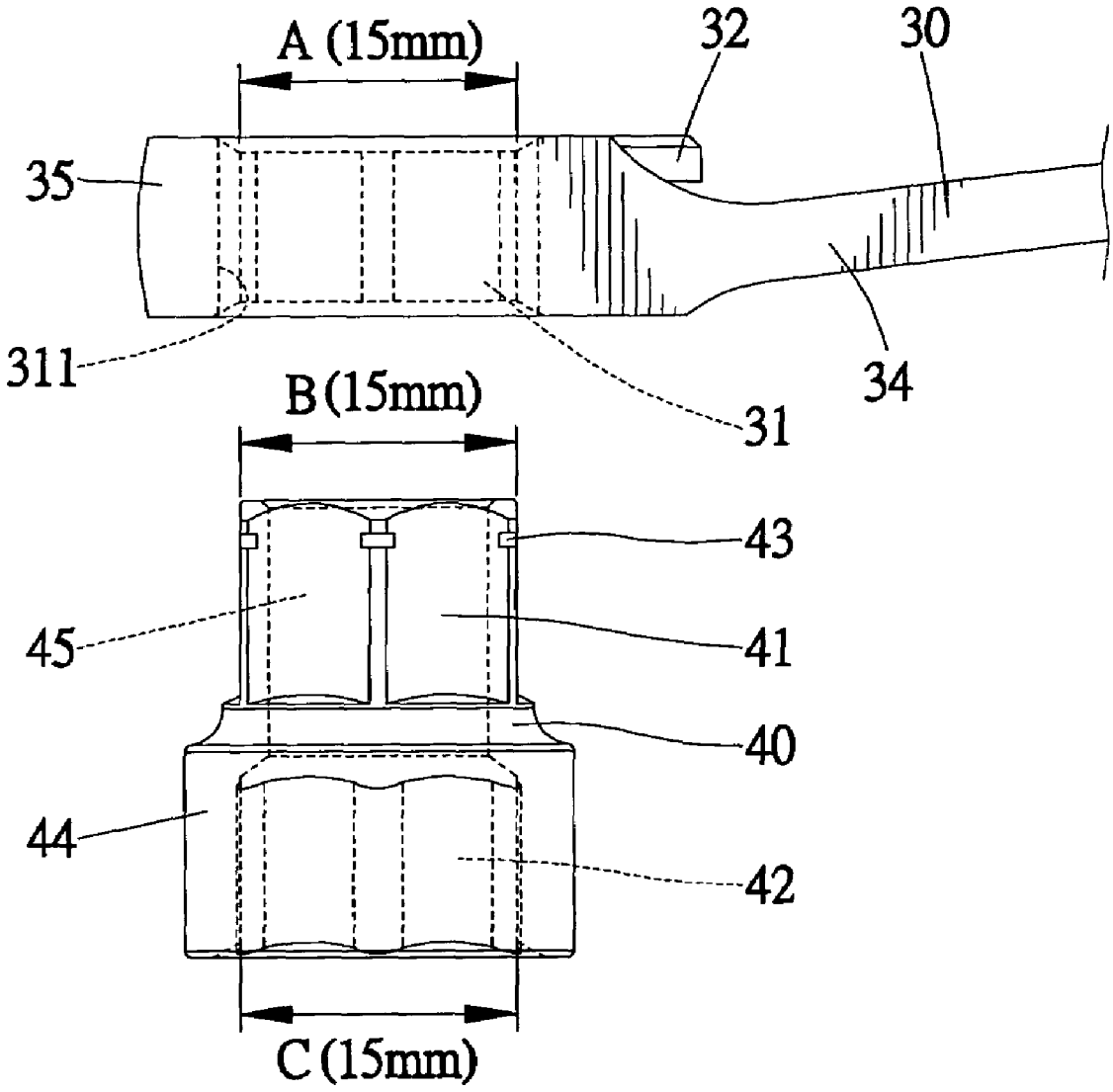
FIG. 2 is an exploded side view of one of a set of wrenches and one of a set of go-through type sockets of a tool kit in accordance with the present invention.

The nominal size A of the wheel 31 of each wrench 30, the nominal size B of the engaging portion 41 of a corresponding one of the sockets 40, and the nominal size C of the driving portion 42 of the corresponding one of the sockets 40 are identical, as shown in FIG. 2. FIG. 4 shows various metric nominal sizes of A, B, and C for the wrenches 30 and the sockets 40.

Figure 10A:
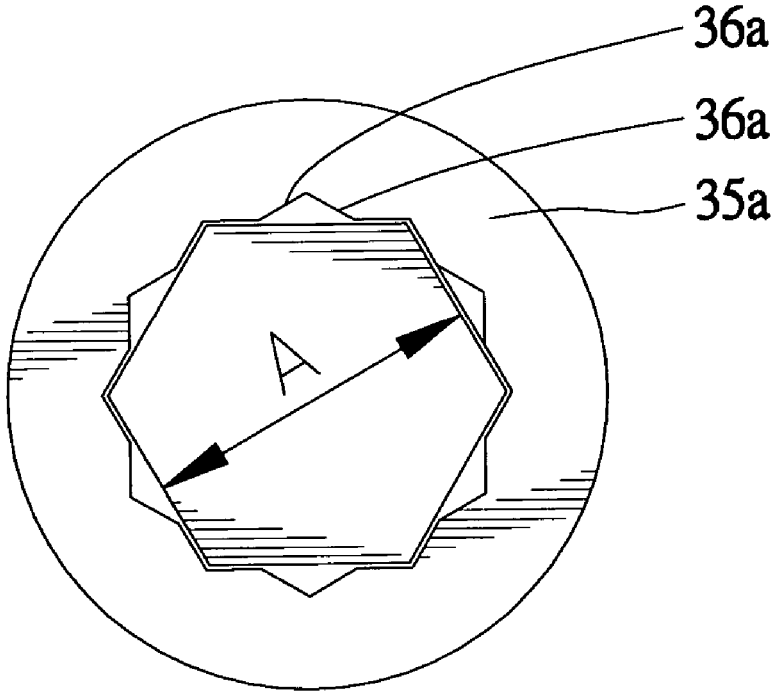
FIG. 10A is a top view of a box end of the wrench in FIG. 10.
Figure 10:
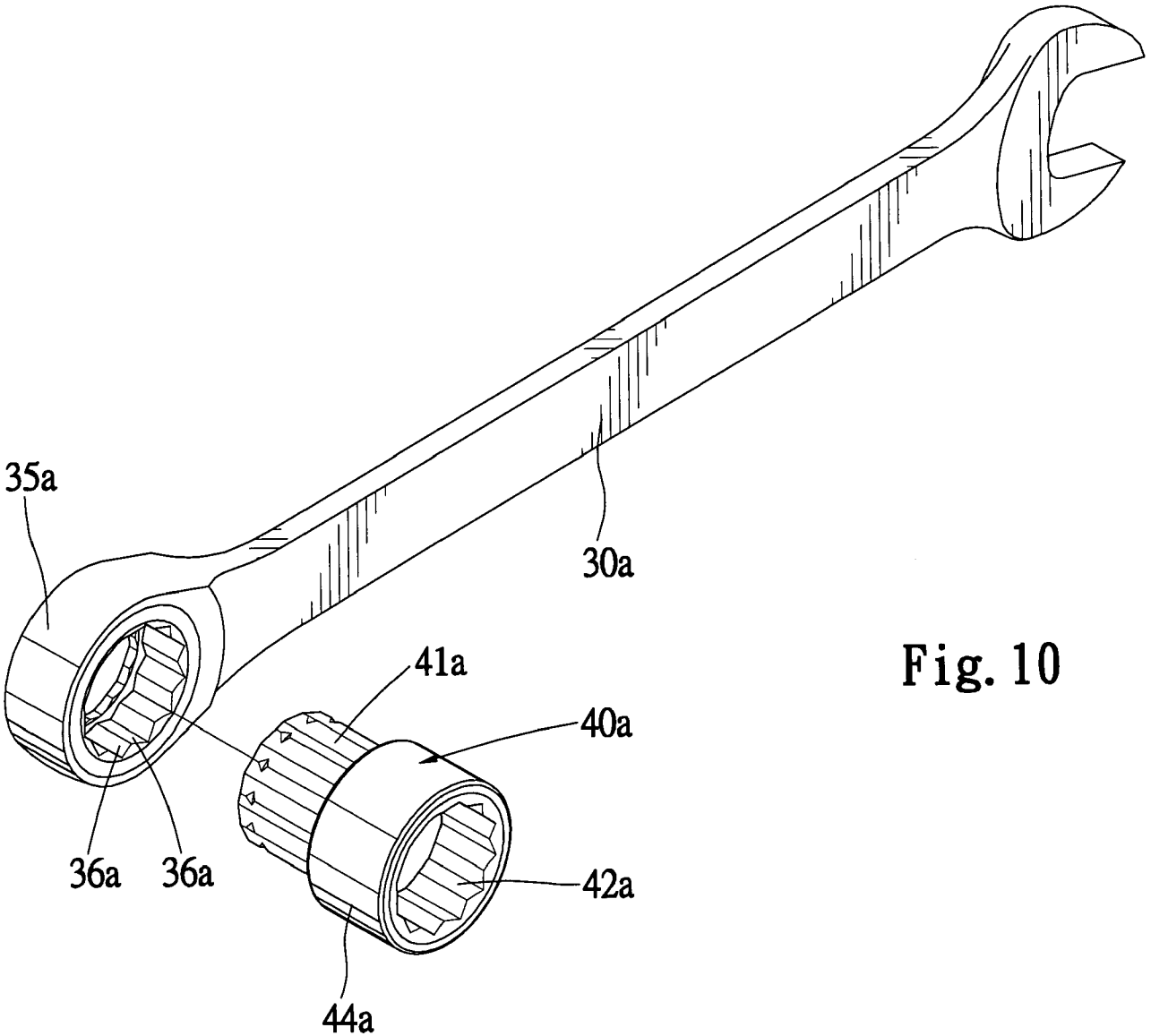
FIG. 10 is an exploded perspective view of another example of a wrench and a corresponding socket of the tool kit in accordance with the present invention.
Figure 11:
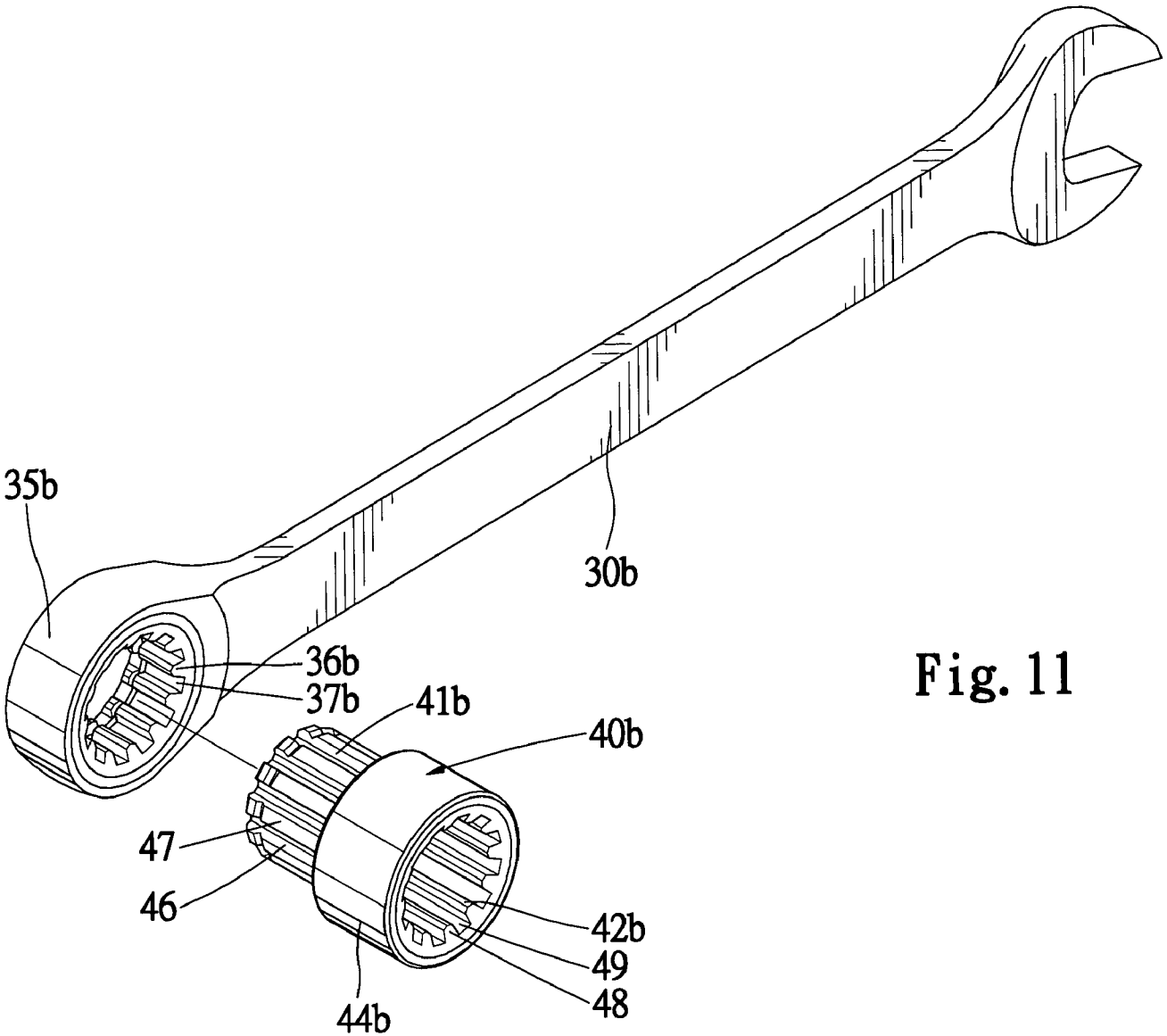
FIG. 11 is an exploded perspective view of a further example of a wrench and a corresponding socket of the tool kit in accordance with the present invention.
Figure 11A:
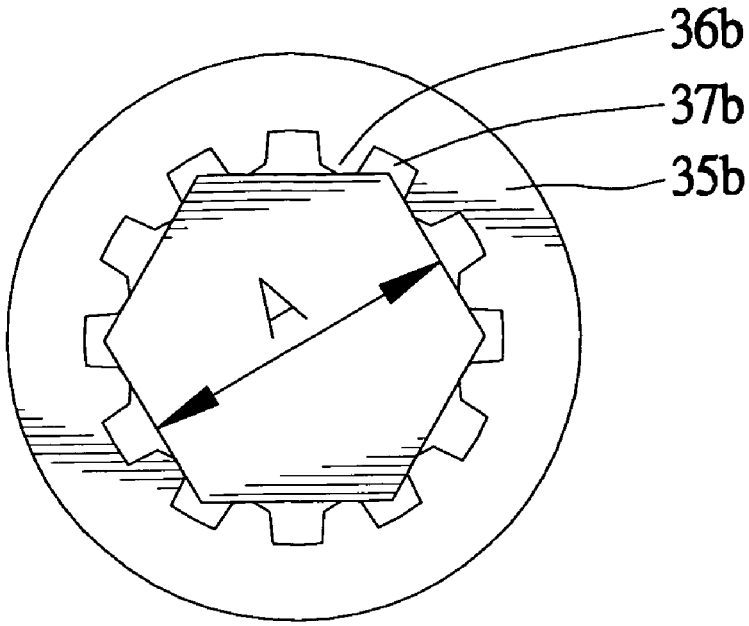
FIG. 11A is a top view of a box end of the wrench in FIG. 11.
Figure 12A:
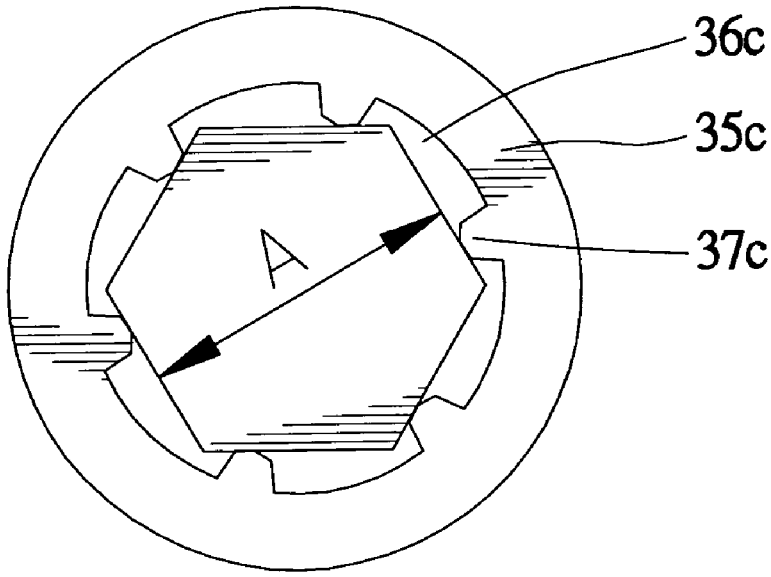
FIG. 12A is a top view of a box end of the wrench in FIG. 12.
Figure 12:
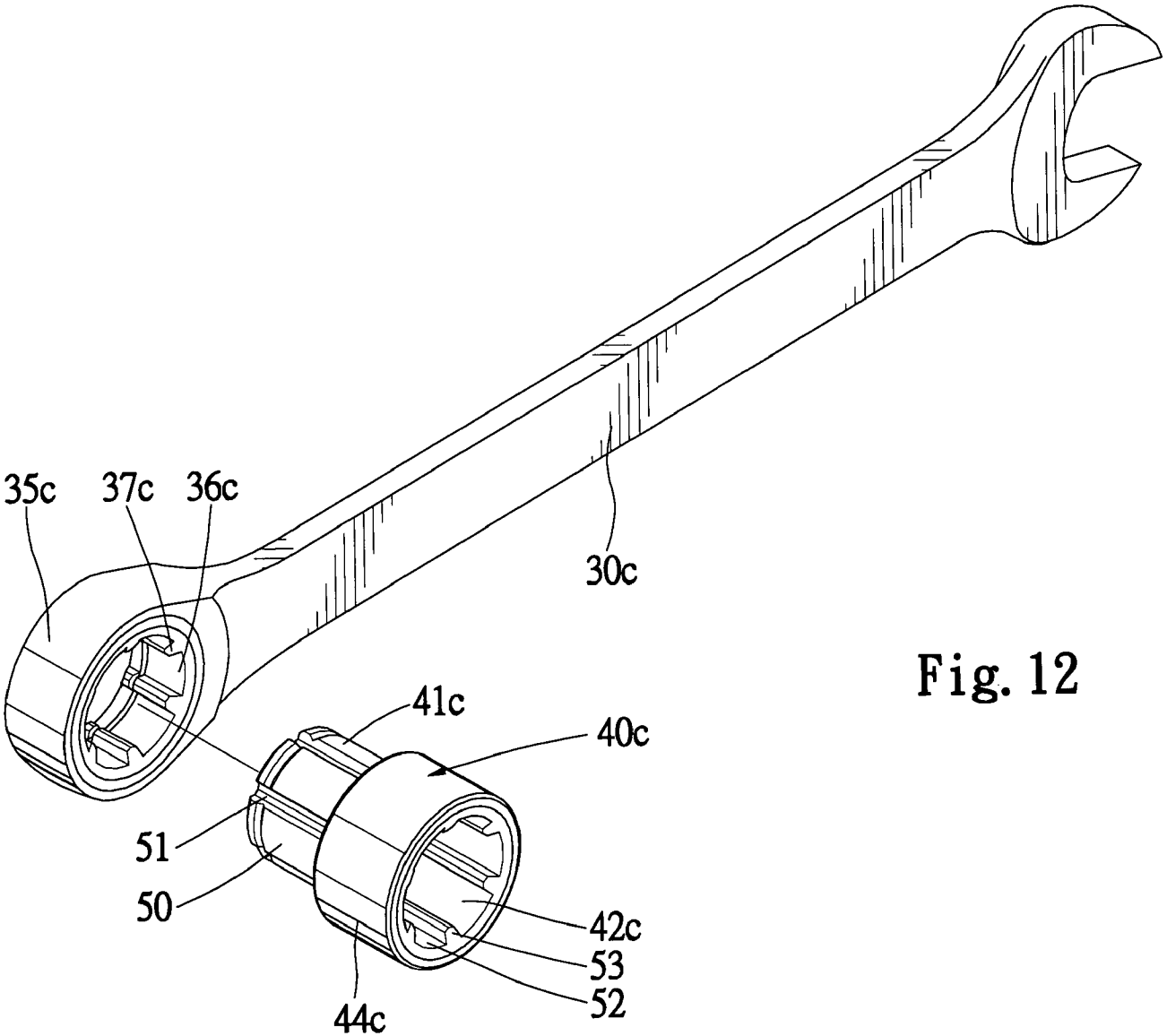
FIG. 12 is an exploded perspective view of still another example of a wrench and a corresponding socket of the tool kit in accordance with the present invention.

FIG. 10 is an exploded perspective view of another example of a wrench 30*a* with a box end 35*a* and a corresponding socket 40*a* of the tool kit in accordance with the present invention. FIG. 10A is a top view of the box end 35*a* of the wrench 30*a* in FIG. 10. FIG. 11 is an exploded perspective view of a further example of a wrench 30*b* with a box end 35*b* and a corresponding socket 40*b* of the tool kit in accordance with the present invention. FIG. 11A is a top view of the box end 35*b* of the wrench 30*b* in FIG. 11. FIG. 12 is an exploded perspective view of still another example of a wrench 30*c* with a box end 35*c* and a corresponding socket 40*c* of the tool kit in accordance with the present invention. FIG. 12A is a top view of the box end 35*c* of the wrench 30*c* in FIG. 12.

Figure 2A:
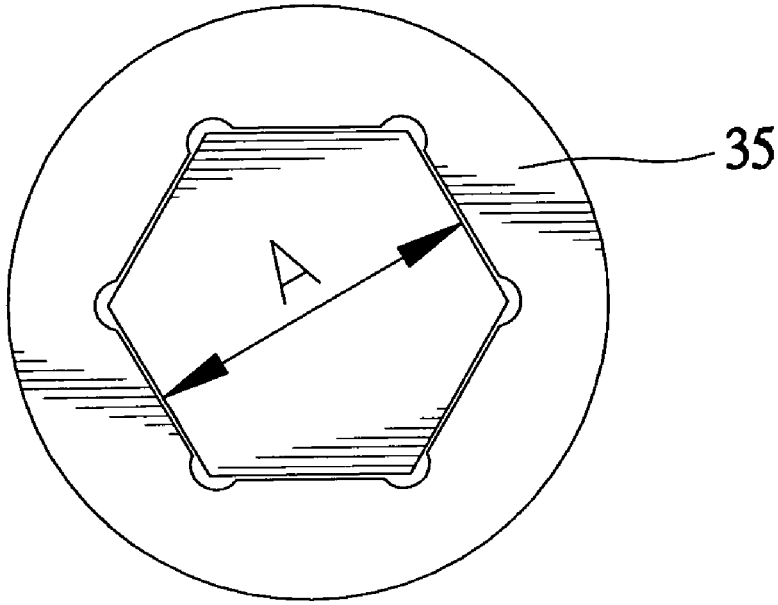
FIG. 2A is a top view of a box end of the wrench in FIG. 2.
Figure 3:
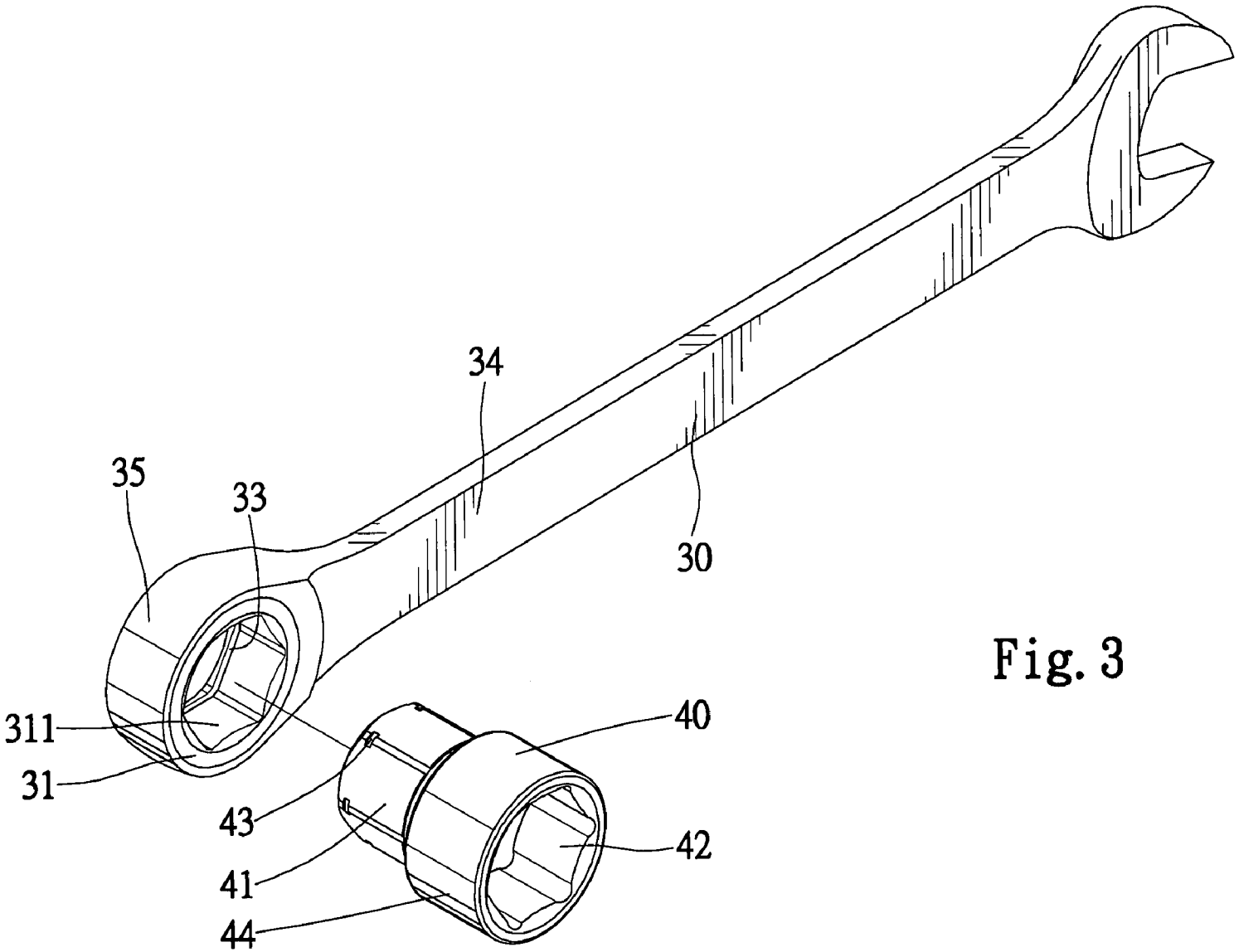
FIG. 3 is an exploded perspective view of the wrench and the socket in FIG. 2.

The inner periphery 311 of the box end 35 of the wrench in FIGS. 2A and 3 includes six faces. The box end 35*a* of the wrench 30*a* in FIGS. 10 and 10A includes an inner periphery in the form of a star polygon with twenty-four (24) faces 36*a*. The engaging portion 41*a* of the socket 40*a* includes a star-polygonal outer periphery, and the driving hole 42*a* of the socket 40*a* is star-polygonal.

The box end 35*b* of the wrench 30*b* in FIGS. 11 and 11A includes an inner periphery having twelve (12) protruded portions 36*b* and twelve (12) recessed portions 37*b* that are alternately disposed. The engaging portion 41*b* of the socket 40*b* includes an outer periphery having a plurality of protruded portions 47 and a plurality of recessed portions 46 that are alternately disposed. The driving hole 42*b* of the socket 40*b* includes an inner periphery having a plurality of protruded portions 48 and a plurality of recessed portions 49 that are alternately disposed.

The box end 35*c* of the wrench 30*c* in FIGS. 12 and 12A includes an inner periphery having six (6) relatively wider recessed portions 36*c* and six (6) relatively narrower protruded portions 37*c* that are alternately disposed. The engaging portion 41*c* of the socket 40*c* includes an outer periphery having a plurality of relatively wider protruded portions 50 and a plurality of relatively narrower recessed portions 51 that are alternately disposed. The driving hole 42*c* of the socket 40*c* includes an inner periphery having a plurality of relatively wider recessed portions 52 and a plurality of relatively narrower protruded portions 53 that are alternately disposed. The engaging portion 41*a*, 41*b*, 41*c* of each socket 40*a*, 40*b*, 40*c* includes a through-hole (not shown) in communication with the driving hole 42*a*, 42*b*, 42*c*.

All of these box ends 35, 35*a*, 35*b*, and 35*c* have the same nominal size A. The engaging portion 41, 41*a*, 41*b*, 41*c* of the corresponding socket 40, 40*a*, 40*b*, 40*c* and the driving hole 42, 42*a*, 42*b*, 42*c* of the corresponding socket 40, 40*a*, 40*b*, 40*c* have the same nominal size A. Measurement of the nominal size (or simply the "size") of the box end of the wrench, the engaging portion of the socket, and the driving hole of the socket are conventional and therefore not described in detail.

The tool kit in accordance with the present invention is not limited to use the box ends and the sockets of the embodiments shown and described. Further, the wheel 31 and its corresponding arrangement as well as switching means 32 shown in FIGS. 2 and 3 can be used in the embodiments of FIGS. 10, 11, and 12.

Figure 5:
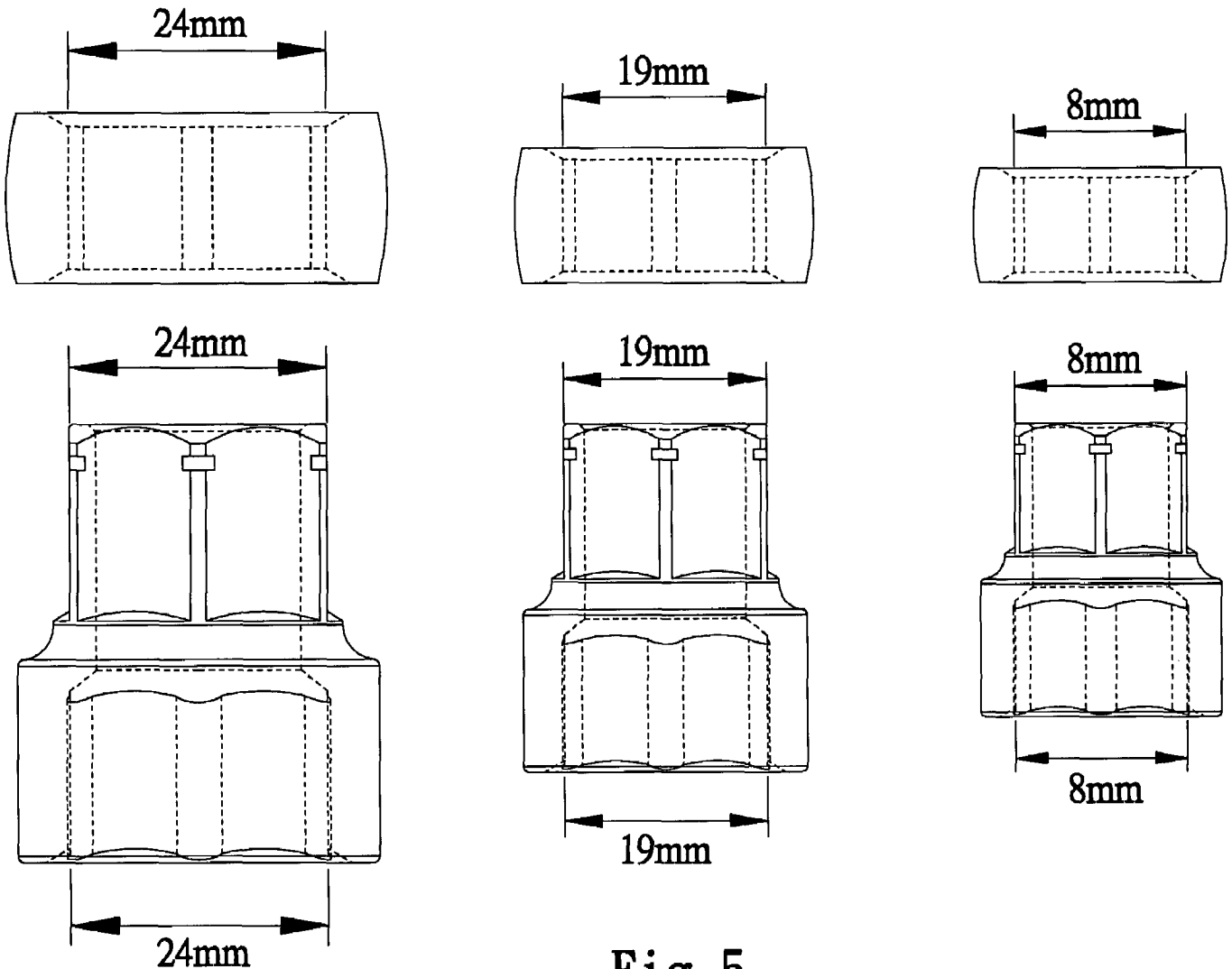
FIG. 5 is a schematic view illustrating an example of the tool kit in accordance with the present invention.

FIG. 5 is an example of a tool kit in accordance with the present invention, wherein the tool kit comprises three wrenches and three go-through type sockets. The nominal sizes A of the wrenches 30 are 24 mm, 19 mm, and 8 mm, respectively. The nominal sizes B of the engaging portions 41 of the sockets 40 are 24 mm, 19 mm, and 8 mm, respectively. The nominal sizes C of the driving holes 42 of the sockets 40 are 24 mm, 19 mm, and 8 mm, respectively. Thus, each of the wrenches 30 of various sizes has a correspondingly sized go-through type socket 40. The torque imparted to the fastener is sufficient. The insufficient torque problem in conventional designs is solved by the wrench and the socket in accordance with the present invention.

Figure 9:
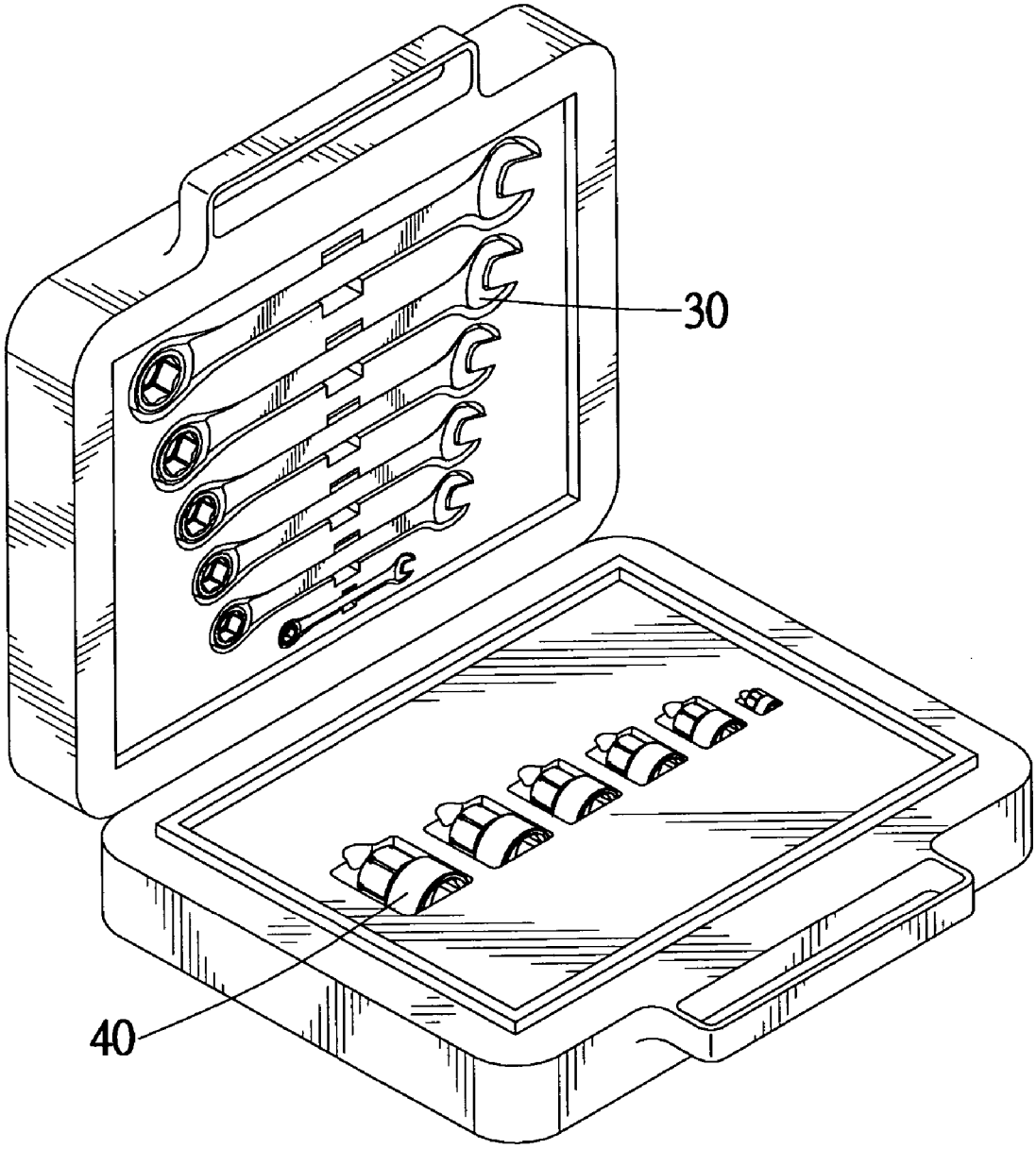

The nominal sizes of the wrenches and the go-through type sockets of the tool kit in accordance with the present invention can be based on the inch system, as shown in FIG. 7. The number of the wrenches and the corresponding number of the go-through type sockets of the tool kit in accordance with the present invention may be as many as desired. For example, FIG. 9 shows a tool kit with six wrenches and six go-through type sockets in accordance with the present invention.

Figure 6:
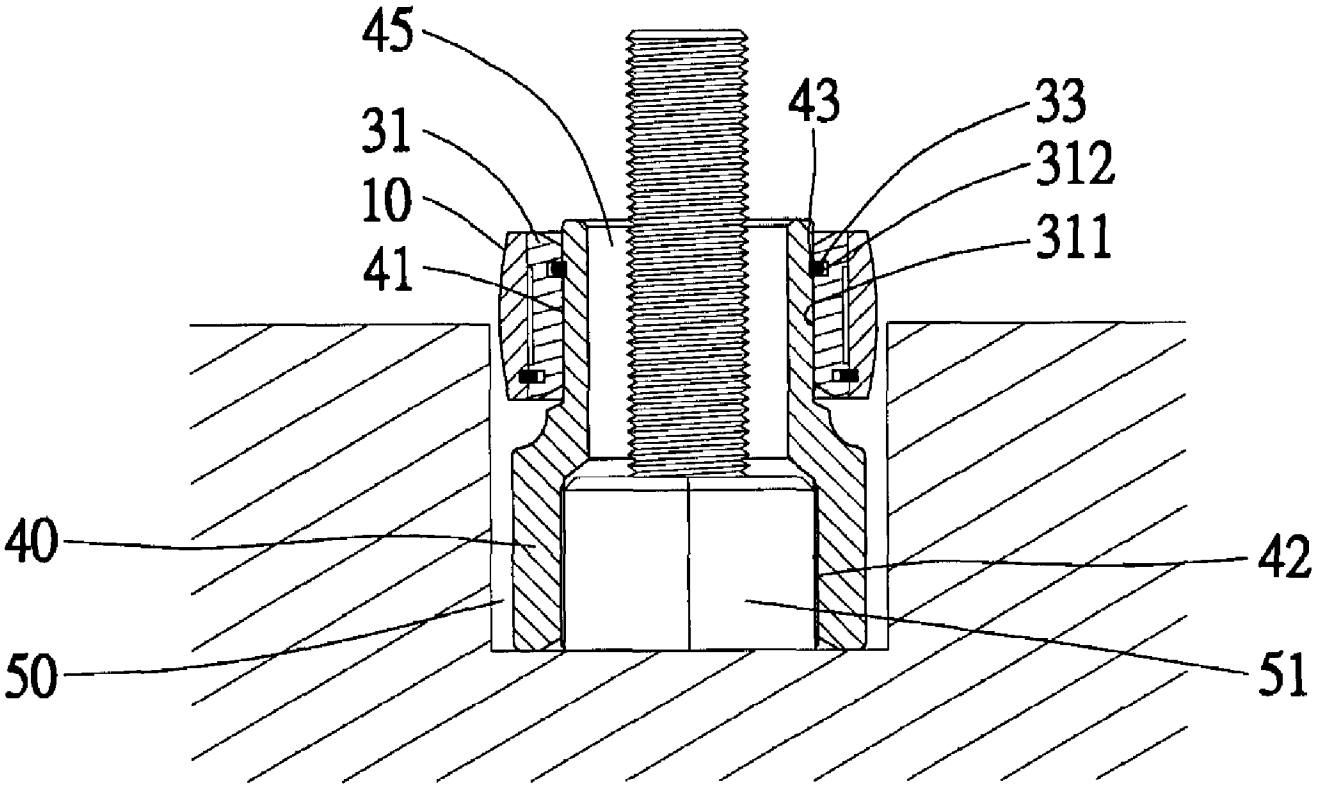
FIG. 6 is a schematic sectional view illustrating use of a wrench and a go-through type socket of the tool kit in accordance with the present invention.

Referring to FIG. 6, in a case for driving a fastener 51 located in a narrow, deep receptacle 50, the user may engage a small-size go-through type socket 40 with the correspondingly sized wrench 30 and insert the combined wrench/socket into the receptacle 50 for accomplishing the driving purposes. Thus, the tool kit in accordance with the present invention is operable in limited operating conditions. Referring to FIGS. 3 and 6, the inner periphery 311 of each wrench 30 may include an annular groove 312, and the engaging portion 41 of the corresponding socket 40 may include a recessed portion 43. A retainer 33 (such as a C-clip) is partially engaged in the recessed portion 43 of the socket 40 and the annular groove 312 of the wrench 30 for securely retaining the socket 40 in the wheel 31 of the corresponding wrench 30.

Although the tool kit in accordance with the present invention includes more than one wrench 30, the overall cost of the tool kit is still relatively low. Further, the overall volume of the tool case for containing the tool kit in accordance with the present invention is not large and thus easy to carry while fulfilling various needs of driving fasteners.

Although specific embodiments have been illustrated and described, numerous modifications and variations are still possible without departing from the essence of the invention. The scope of the invention is limited by the accompanying claims.

What is claimed is:

1. A tool kit comprising:

a number of wrenches of various sizes, each said wrench comprising a handle with a box end, the box end having a nominal size; and a corresponding number of go-through type sockets, each said socket comprising an engaging portion for engaging with the box end of a corresponding one of the wrenches, the engaging portion including a nominal size the same as that of the corresponding one of the wrenches, each said socket further comprising a driving portion including a driving hole with a nominal size the same as that of the corresponding one of the wrenches.

2. The tool kit as claimed in claim 1, with each said wrench further including a wheel that is rotatably mounted in the box end of the handle and that defines an inner periphery with the nominal size.

3. The tool kit as claimed in claim 2, with each said wrench further including means for changing a driving rotation direction and a free rotation direction of each said wrench.

4. The tool kit as claimed in claim 1, with the box end of each said wrench including a polygonal inner periphery.

5. The tool kit as claimed in claim 1, with the engaging portion and the driving hole of each said socket being polygonal.

6. The tool kit as claimed in claim 2, with the inner periphery of the wheel of each said wrench including an annular groove, and with each said wrench further including a retainer for retaining the engaging portion of a corresponding one of the sockets.

7. The tool kit as claimed in claim 1, with the engaging portion of each said socket including a recessed portion, and with the corresponding one of the wrenches including means for engaging the recessed portion of the socket.

8. The toolkit as claimed in claim 1, with the number of the wrenches is greater than two.

9. The tool kit as claimed in claim 1, with the engaging portion of each said socket including a through-hole in communication with the driving hole of the socket.

10. The tool kit as claimed in claim 1, with the box end of each said wrench including a star-polygonal inner periphery.

11. The tool kit as claimed in claim 1, with the engaging portion of each said socket including a star-polygonal outer periphery, and with the driving hole of each said socket being star-polygonal.

12. The tool kit as claimed in claim 1, with the box end of each said wrench including an inner periphery having a plurality of protruded portions and a plurality of recessed portions that are alternately disposed.

13. The tool kit as claimed in claim 1, with the engaging portion of each said socket including an outer periphery having a plurality of protruded portions and a plurality of recessed portions that are alternately disposed, and with the driving hole of each said socket including an inner periphery having a plurality of protruded portions and a plurality of recessed portions that are alternately disposed.

14. The tool kit as claimed in claim 1, with the box end of each said wrench including an inner periphery having a plurality of relatively wider recessed portions and a plurality of relatively narrower protruded portions that are alternately disposed.

15. The tool kit as claimed in claim 1, with the engaging portion of each said socket including an outer periphery having a plurality of relatively wider protruded portions and a plurality of relatively narrower recessed portions that are alternately disposed, and with the driving hole of each said socket including an inner periphery having a plurality of relatively wider recessed portions and a plurality of relatively narrower protruded portions that are alternately disposed.

16. A go-through type socket kit comprising at least three go-through type sockets of various sizes, each said go-through type socket comprising an engaging portion adapted to be engage with a box end of a wrench, each said go-through type socket further comprising a driving portion with a driving hole adapted to drive a fastener, the engaging portion of each said go-through type socket comprising an outer periphery with a nominal size that same as that of the driving hole.

17. The go-through type socket kit as claimed in claim 16, with the engaging portion of each said go-through type socket including a through-hole in communication with the driving hole.

18. The go-through type socket kit as claimed in claim 16, with the engaging portion of each said go-through type socket including a recessed portion.

19. The go-through type socket kit as claimed in claim 16, with the engaging portion of each said socket including a star-polygonal outer periphery, and with the driving hole of each said socket being star-polygonal.

20. The go-through type socket kit as claimed in claim 16, with the engaging portion of each said socket including an outer periphery having a plurality of protruded portions and a plurality of recessed portions that are alternately disposed, and with the driving hole of each said socket including an inner periphery having a plurality of protruded portions and a plurality of recessed portions that are alternately disposed.

21. The go-through type socket kit as claimed in claim 16, with the engaging portion of each said socket including an outer periphery having a plurality of relatively wider protruded portions and a plurality of relatively narrower recessed portions that are alternately disposed, and with the driving hole of each said socket including an inner periphery having a plurality of relatively wider recessed portions and a plurality of relatively narrower protruded portions that are alternately disposed.

22. The go-through type socket kit as claimed in claim 16, with the engaging portion and the driving hole of each said socket being polygonal.

* * * * *